US005719547A

United States Patent [19]

Kaneko et al.

[11] Patent Number: 5,719,547

[45] Date of Patent: Feb. 17, 1998

[54] TRANSFORMER WITH BIFILAR WINDING

[75] Inventors: Toshimi Kaneko; Masahiro Bando, both of Sabae, Japan

[73] Assignee: Murata Manufacturing Co., Ltd., Nagaokakyo, Japan

[21] Appl. No.: 513,627

[22] Filed: Aug. 10, 1995

[30] Foreign Application Priority Data

Aug. 12, 1994 [JP] Japan ..... 6-190543

[51] Int. Cl.[6] ..... H01F 27/30; H01F 27/29

[52] U.S. Cl. ..... 336/180; 336/183; 336/192

[58] Field of Search ..... 336/192, 181, 336/180, 170, 221, 183, 185

[56] References Cited

U.S. PATENT DOCUMENTS 1,732,937 10/1929 Jones ..... 336/181
1,762,775 6/1930 Ganz ..... 336/181

FOREIGN PATENT DOCUMENTS 60-102709 6/1985 Japan ..... 336/180

*Primary Examiner*—Thomas J. Kozma
*Attorney, Agent, or Firm*—Burns, Doane, Swecker & Mathis, LLP

[57] ABSTRACT

A transformer which has a core, a wire for a primary coil and two wires for a secondary coil. The wire for a primary coil and one of the wires for a secondary coil are wound around a body of the core together, that is, are bifilar-wound. The other wire for a secondary coil is single-wound around the bifilar-wound wires. The two wires for a secondary coil are connected in series to form a secondary coil, and the wire for a primary coil forms a primary coil by itself.

10 Claims, 5 Drawing Sheets

TRANSFORMER WITH BIFILAR WINDING

BACKGROUND OF THE INVENTION

1. Field of the Invention

The present invention relates to a transformer, and more particularly to a transformer used as a power transformer of a DC—DC converter or the like.

2. Description of Related Art

Conventionally, transformers have a structure wherein a first wire for a primary coil is wound around a ferrite core and a second wire for a secondary coil is wound around the first wire. In the structure, the coefficient of coupling between the primary coil and the secondary coil is not large. In order to improve the coefficient of coupling, the ferrite core wound with the first and second wires is covered by a ferrite case. However, this does not bring a satisfying result.

SUMMARY OF THE INVENTION

An object of the present invention is to provide a transformer which has a large coefficient of coupling between a primary coil and a secondary coil.

In order to attain the object, a transformer according to the present invention comprises: a core; a first wire and a second wire which are bifilar-wound around the core; and a third wire which is electrically connected to either the first wire or the second wire in series and is single-wound around the core. In the transformer, the third wire and the first or second wire which is electrically connected to the third wire form a secondary coil, and the other wire which is not electrically connected to the third wire forms a primary coil.

In the structure, the bifilar-wound wires are closely coupled magnetically, and thereby, the coefficient of coupling between the primary coil and the secondary coil is increased. The bifilar winding means winding the two wires around the core simultaneously and therefore shortens the time required for the winding of the wires. Further, automation of the bifilar winding is possible, and the transformer is suited for mass production.

BRIEF DESCRIPTION OF THE DRAWINGS

This and other objects and features of the present invention will be apparent from the following description with reference to the accompanying drawings, in which.

DETAILED DESCRIPTION OF THE PREFERRED EMBODIMENTS

Preferred embodiments of the present invention are described with reference to the accompanying drawings.

The same parts and members which are used in the embodiments are provided with the same reference symbols.

Figure 1:
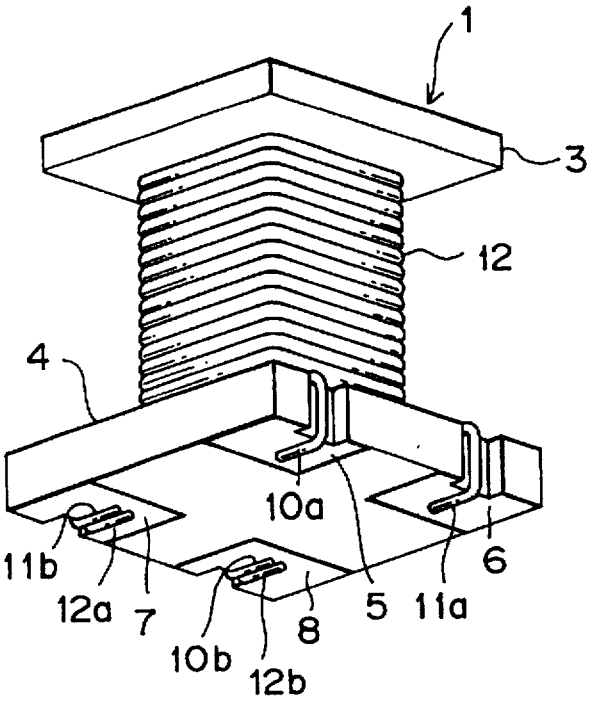
FIG. 1 is a perspective view of a transformer which is a first embodiment of the present invention.
Figure 2:
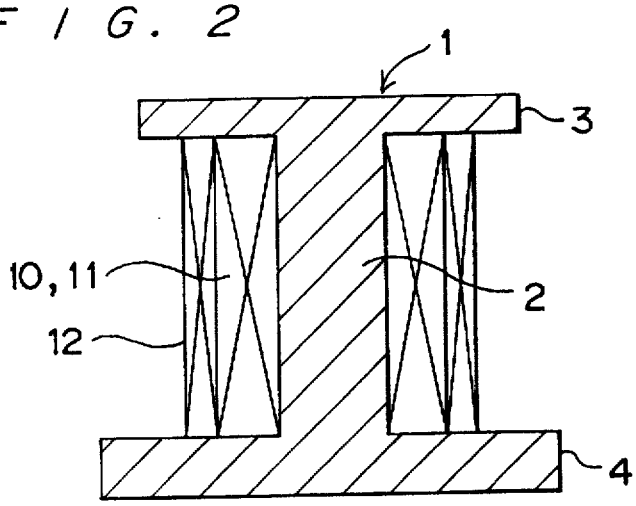
FIG. 2 is a sectional view of the transformer of FIG. 1.
Figure 3:
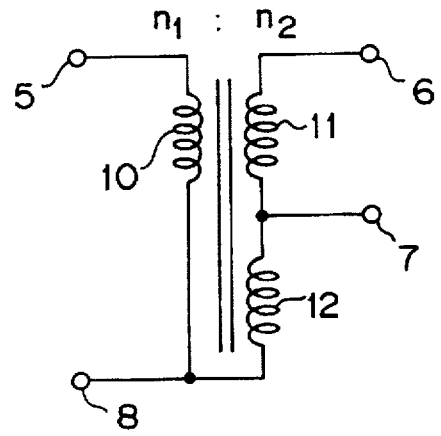
FIG. 3 is an electric equivalent circuit diagram of the transformer of FIG. 1.

First Embodiment: FIGS. 1 through 3

As shown in FIGS. 1 and 2, a transformer of the first embodiment comprises a core 1, a wire 10 for a primary coil, and wires 11 and 12 for a secondary coil. The core 1 has a body 2 and flanges 3 and 4 which are provided on both ends of the body 2. The body 2 is rectangular in cross section. On the lower surface of the lower flange 4 of the core 1, a primary electrode 5, a secondary electrode 6, a junction electrode 7 and a common grounding electrode 8 are provided. As the material of the core 1, for example, a magnetic material such as ferrite or an insulating material such as resin is used.

Around the body 2 of the core 1, the wires 10, 11 and 12 are wound. The wires 10, 11 and 12 are copper wires coated with an insulating film such as polyurethane. The wire 10 for a primary coil and the wire 11 for a secondary coil have wiring start portions 10*a* and 11*a* which are electrically connected and fixed to the primary electrode 5 and the secondary electrode 6, respectively, by compression bonding, welding, soldering or the like. The wire 10 for a primary coil and the wire 11 for a secondary coil are wound around the body 2 of the core 1 together, that is, are bifilar-wound. Then, the wires 10 and 11 are electrically connected and fixed to the common grounding electrode 8 and the junction electrode 7, respectively, at respective winding end portions 10*b* and 11*b* by compression bonding, soldering or the like.

The other wire 12 for a secondary coil has a winding start portion 12*a* which is electrically connected and fixed to the junction electrode 7 by compression bonding, soldering or the like. The wire 12 is single-wound around the bifilar-wound wires 10 and 11, and is electrically connected and fixed to the common grounding electrode 8 at a winding end portion 12*b* by compression bonding, soldering or the like.

In this way, a transformer with an intermediate tap is obtained. FIG. 3 shows the electric equivalent circuit of the transformer. The wires 11 and 12 are electrically connected in series to form a secondary coil which has winding of $n_2$ times. The wire 10 forms a primary coil which has winding of $n_1$ times ($n_1<n_2$). In this transformer, the wire 10 of the primary coil and the wire 11 of the secondary coil are closely coupled magnetically. Accordingly, the coefficient of coupling between the primary coil and the secondary coil is large. Additionally, since the wires 10 and 11 are wound around the body 2 of the core 1 simultaneously, only a short time is required for the winding of the wires 10 and 11, and automatic winding is possible.

Now, referring to specific values, the improvement in coupling between the primary coil and the secondary coil is described in more detail. Copper wires with a diameter of 0.1 mm were used as the wires 10, 11 and 12. The number of times of the bifilar winding of the wires 10 and 11 and the number of times of the single winding of the wire 12 were both 15. In this case, the coefficient of coupling between the primary coil and the secondary coil was 99%. In a conventional transformer, on the other hand, when the number of times of winding of a primary coil and that of a secondary coil were 15 and 30, respectively, the coefficient of coupling between the primary coil and the secondary coil was 87%.

Figure 4:
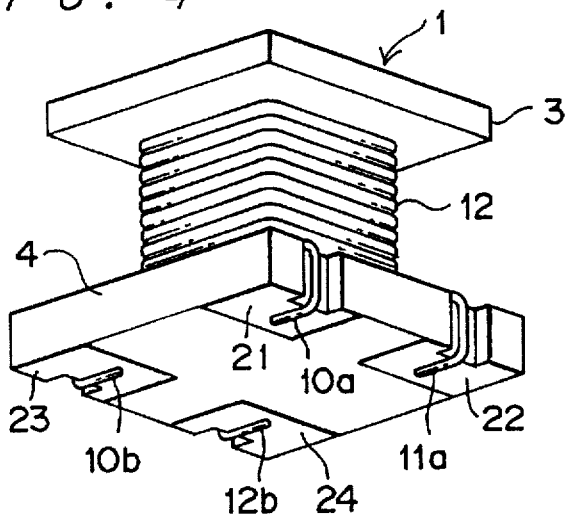
FIG. 4 is a perspective view of a transformer which is a second embodiment of the present invention.
Figure 5:
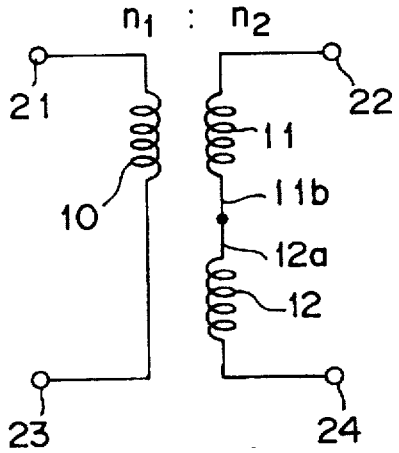
FIG. 5 is an electric equivalent circuit diagram of the transformer of FIG. 4.

Second Embodiment: FIGS. 4 and 5

A transformer of the second embodiment does not have an intermediate tap. As shown in FIGS. 4 and 5, the transformer comprises a core 1, a wire 10 for a primary coil, and wires 11 and 12 for a secondary coil. On the lower surface of the lower flange 4 of the core 1, a primary electrode 21, a secondary electrode 22, a primary grounding electrode 23 and a secondary grounding electrode 24 are provided.

The wire 10 for a primary coil and the wire 11 for a secondary coil have winding start portions 10*a* and 11*a* which are electrically connected and fixed to the primary electrode 21 and the secondary electrode 22, respectively, by compression bonding, soldering or the like. The wires 10 and 11 are bifilar-wound around the body 2 of the core 1. The wire 10 is electrically connected and fixed to the primary grounding electrode 23 at a winding end portion 10*b*. On the other hand, the wire 11 is not cut at a winding end portion 11*b* and continues to be wound as the wire 12. Accordingly, the winding end portion 11*b* of the wire 11 serves as a winding start portion 12*a* of the wire 12. It is possible to use separate wires as the wires 11 and 12, and in this case, the winding end portion 11*b* of the wire 11 and the winding start portion 12*a* of the wire 12 are joined. The wire 12 is single-wound around the bifilar-wound wires 10 and 11, and the wire 12 is electrically connected and fixed to the secondary grounding electrode 24 at a winding end portion 12*b*.

In the transformer of the second embodiment, the wires 11 and 12 are electrically connected in series to form a secondary coil which has winding of $n_2$ times, and the wire 10 forms a primary coil which has winding of $n_1$ times ($n_1<n_2$). This transformer has the same effect as the transformer of the first embodiment.

Figure 6:
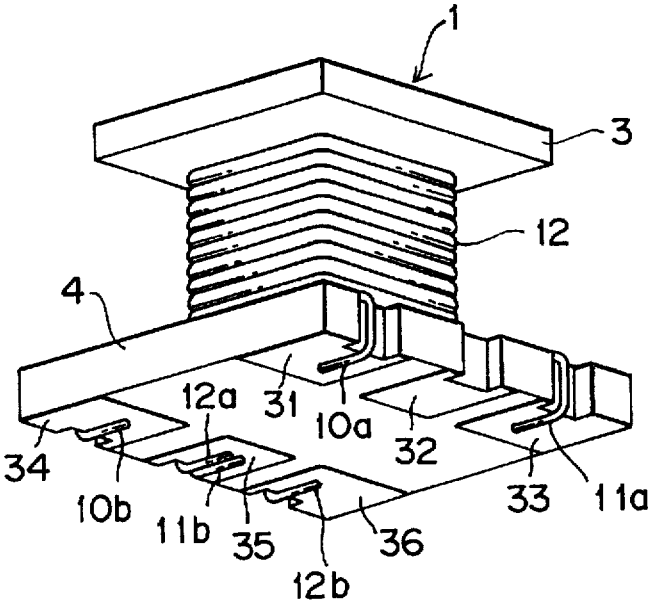
FIG. 6 is a perspective view of a transformer which is a third embodiment of the present invention.

Third Embodiment: FIG. 6

As shown in FIG. 6, a transformer of the third embodiment has a primary electrode 31, junction electrodes 32 and 35, a secondary electrode 33, a primary grounding electrode 34 and a secondary grounding electrode 38 on the lower surface of the lower flange 4 of the core 1.

The wire 10 for a primary coil and the wire 11 for a secondary coil are electrically connected and fixed to the primary electrode 31 and the secondary electrode 33, respectively, at respective winding start portions 10*a* and 11*a*. The wires 10 and 11 are bifilar-wound around the body 2 of the core 1. Then, the wires 10 and 11 are electrically connected and fixed to the primary grounding electrode 34 and the junction electrode 35, respectively, at respective winding end portions 10*b* and 11*b*.

The other wire 12 for a secondary coil is electrically connected and fixed to the junction electrode 35 at a winding start portion 12*a*, and is single-wound around the bifilar-wound wires 10 and 11. Then, the wire 12 is electrically connected and fixed to the secondary grounding electrode 36 at a winding end portion 12*b*.

In the transformer of the third embodiment, the wires 11 and 12 are electrically connected in series to form a secondary coil which has winding of $n_2$ times, and the wire 10 forms a primary coil which has winding of $n_1$ times ($n_1<n_2$). This transformer has the same effect as the transformer of the first embodiment.

Figure 7:
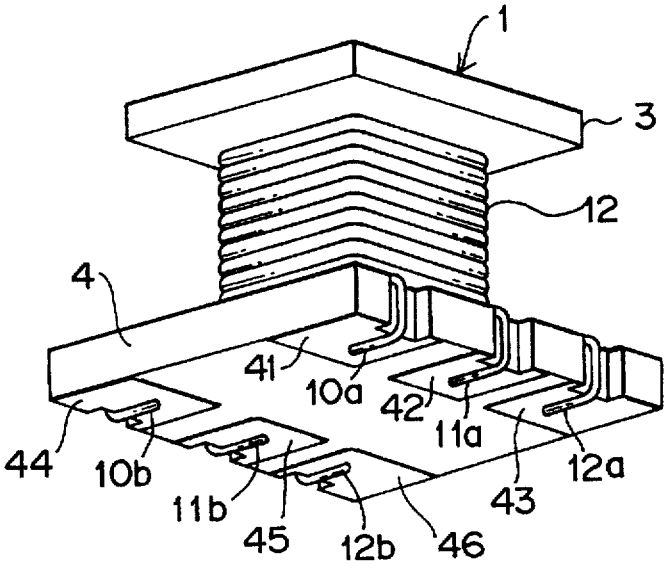
FIG. 7 is a perspective view of a transformer which is a fourth embodiment of the present invention.

Fourth Embodiment: FIG. 7

As shown in FIG. 7, a transformer of the fourth embodiment has a primary electrode 41, a secondary electrode 42, junction electrodes 43 and 45, a primary grounding electrode 44 and a secondary grounding electrode 46 on the lower surface of the lower flange 4 of the core 1.

The wire 10 for a primary coil and the wire 11 for a secondary coil are electrically connected and fixed to the primary electrode 41 and the secondary electrode 42, respectively, at respective winding start portions 10*a* and 11*a*. The wires 10 and 11 are bifilar-wound around the body 2 of the core 1. Then, the wires 10 and 11 are electrically connected and fixed to the primary grounding electrode 44 and the junction electrode 45, respectively, at respective winding end portions 10*b* and 11*b*.

The other wire 12 for a secondary coil is electrically connected and fixed to the junction electrode 43 at a winding start portion 12*a*, and is single-wound around the bifilar-wound wires 10 and 11. Then, the wire 12 is electrically connected and fixed to the secondary grounding electrode 46 at a winding end portion 12*b*.

The transformer of the fourth embodiment is mounted on a printed circuit board (not shown) which has a junction conductor, and thereby, the junction electrodes 43 and 45 are electrically connected via the junction conductor. Consequently, the wires 11 and 12 are electrically connected in series to form a secondary coil which has winding of $n_2$ times, and the wire 10 forms a primary coil which has winding of $n_1$ times ($n_1<n_2$). This transformer has the same effect as the transformer of the first embodiment.

Figure 8:
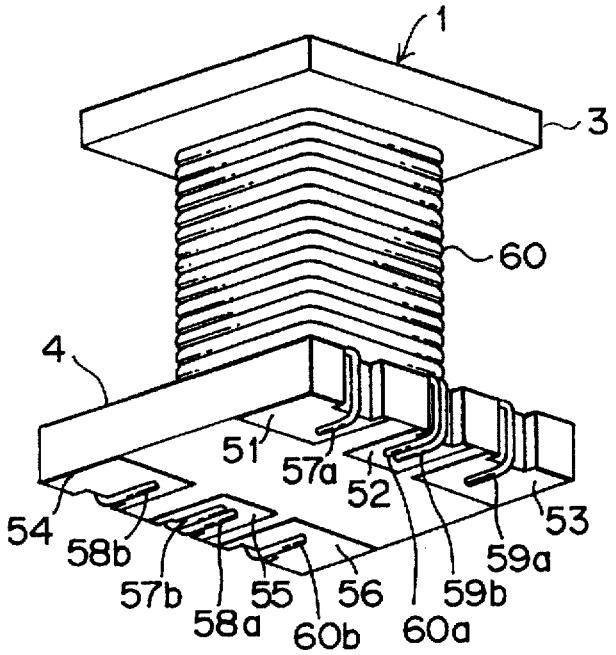
FIG. 8 is a perspective view of a transformer which is a fifth embodiment of the present invention.
Figure 9:
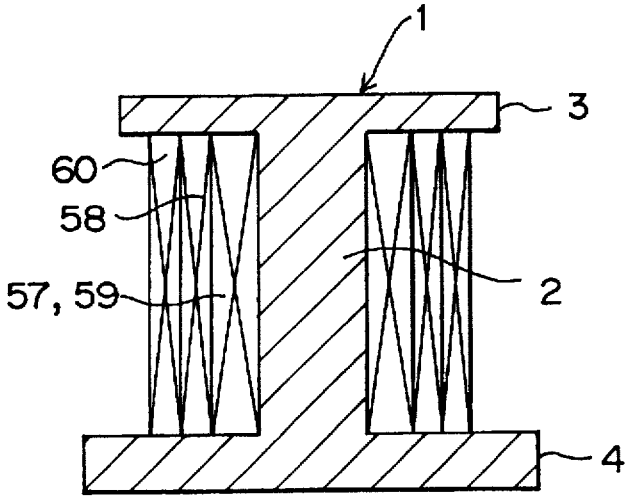
FIG. 9 is a sectional view of the transformer of FIG. 8.
Figure 10:
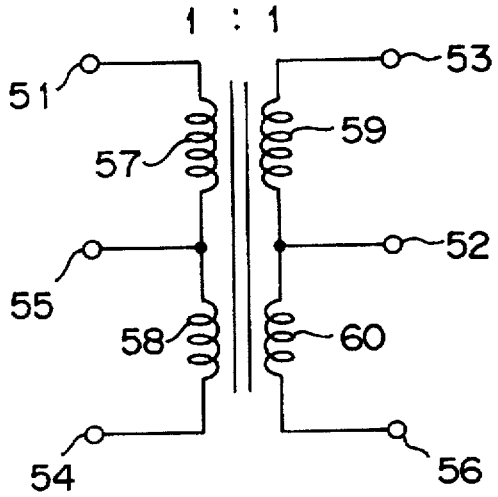
FIG. 10 is an electric equivalent circuit diagram of the transformer of FIG. 8.

Fifth Embodiment: FIGS. 8 through 10

As shown in FIGS. 8 and 9, a transformer of the fifth embodiment comprises a core 1, wires 57 and 58 for a primary coil, and wires 59 and 60 for a secondary coil. On the lower surface of the lower flange 4 of the core 1, a primary electrode 51, junction electrodes 52 and 55, a secondary electrode 53, a primary grounding electrode 54 and a secondary grounding electrode 56 are provided.

The wire 57 for a primary coil and the wire 59 for a secondary coil are electrically connected and fixed to the primary electrode 51 and the secondary electrode 53, respectively, at respective winding start portions 57*a* and 59*a*. The wires 57 and 59 are bifilar-wound around the body 2 of the core 1. Then, the wires 57 and 59 are electrically connected and fixed to the junction electrodes 55 and 52, respectively, at respective winding end portions 57*b* and 59*b*.

The wire 58 for a primary coil is electrically connected and fixed to the junction electrode 55 at a winding start portion 58*a*, and is single-wound around the bifilar-wound wires 57 and 59. Then, the wire 58 is electrically connected and fixed to the primary grounding electrode 54 at a winding end portion 58*b*.

The wire 60 for a secondary coil is electrically connected and fixed to the junction electrode 52 at a winding start portion 60*a*, and is single-wound around the wire 58. Then, the wire 60 is electrically connected and fixed to the secondary grounding electrode 58 at a winding end portion 60*b*.

The wires 57 and 58 are electrically connected in series to form a primary coil which has winding of $n_3$ times, and the wires 59 and 60 are electrically connected in series to form a secondary coil which has winding of $n_3$ times. The number of times of winding of the primary coil and that of the secondary coil are in the ratio of 1 to 1. This transformer has the same effect as the transformer of the first embodiment.

Other Embodiments

It is possible to cover the core wound with wires by a ferrite case so as to further increase the coefficient of coupling between the primary coil and the secondary coil.

Although the present invention has been described in connection with the preferred embodiments above, it is to be noted that various changes and modifications are possible to those who are skilled in the art. Such changes and modifications are to be understood as being within the scope of the present invention.

What is claimed is:

1. A transformer comprising:

a core which is made of a magnetic material, the core having a body and flanges which are provided at both ends of the body;

a first wire and a second wire which are bifilar-wound around the body of the core; and a third wire which is single-wound around the body of the core outside of the first and the second wires, the third wire being electrically connected to the second wire in series;

wherein:

the third wire and the second wire which are electrically connected together form a secondary coil; and the first wire which is not electrically connected to the third wire forms a primary coil.

2. A transformer as claimed in claim 1, wherein:

the second and third wires for a secondary coil are connected via a junction electrode provided on one of the flanges.

3. A transformer as claimed in claim 1, wherein:

one of the flanges has a primary electrode, a secondary electrode, a grounding electrode and a junction electrode thereon;

the first wire for a primary coil is connected to the primary electrode at one end and is connected to the grounding electrode at the other end;

the second wire for a secondary coil is connected to the secondary electrode at one end and is connected to the junction electrode at the other end; and the third wire for a secondary coil is connected to the junction electrode at one end and is connected to the grounding electrode at the other end.

4. A transformer as claimed in claim 1, wherein:

the third wire extends from the second wire.

5. A transformer as claimed in claim 1, wherein:

one of the flanges has a primary electrode, a primary grounding electrode, a secondary electrode, a secondary grounding electrode and a junction electrode thereon;

the first wire for a primary coil is connected to the primary electrode at one end and is connected to the primary grounding electrode at the other end;

the second wire for a secondary coil is connected to the secondary electrode at one end and is connected to the junction electrode at the other end; and the third wire for a secondary coil is connected to the junction electrode at one end and is connected to the secondary grounding electrode at the other end.

6. A transformer as claimed in claim 1, wherein:

one of the flanges has a primary electrode, a primary grounding electrode, a secondary electrode and a secondary grounding electrode, a first junction electrode and a second junction electrode thereon;

the first wire for a primary coil is connected to the primary electrode at one end and is connected to the primary grounding electrode at the other end;

the second wire for a secondary coil is connected to the secondary electrode at one end and is connected to the first junction electrode at the other end; and the third wire for a secondary coil is connected to the second junction electrode at one end and is connected to the secondary grounding electrode.

7. A transformer as claimed in claim 4, wherein:

the third wire is a continued portion of said second wire.

8. A transformer as claimed in claim 4, wherein:

the third wire and the second wire are separate wires which are joined together.

9. A transformer as claimed in claim 4, wherein:

one of said flanges has a primary electrode, a secondary electrode, a primary grounding electrode and a secondary grounding electrode disposed thereon;

the first wire for the primary coil is connected to the primary electrode at one end and is connected to the primary grounding electrode at the other end;

the second wire for the secondary coil is connected to the secondary electrode at one end and is connected to said third wire at the other end;

the third wire for the secondary coil is connected to the second wire at one end and is connected to the secondary grounding electrode at the other end.

10. A transformer comprising:

a core which is made of a magnetic material, the core having a body and flanges which are provided at both ends of the body;

a first wire and a second wire which are bifilar-wound around the body of the core; and a third wire which is single-wound around the body of the core outside of the first and the second wires, the third wire being electrically connected to the first wire in series;

wherein:

the third wire and the first wire which are electrically connected together form a secondary coil; and the second wire which is not electrically connected to the third wire forms a primary coil.

* * * * *